US005222790A

United States Patent [19]

Latino

[11] Patent Number: 5,222,790

[45] Date of Patent: Jun. 29, 1993

[54] FILE CABINET

[75] Inventor: Richard M. Latino, Holden, Mass.

[73] Assignee: Wright Line, Inc., Worcester, Mass.

[21] Appl. No.: 612,359

[22] Filed: Nov. 13, 1990

[51] Int. Cl.[5] ..... A47B 88/00

[52] U.S. Cl. ..... 312/315; 312/323; 49/257

[58] Field of Search ..... 312/315, 316, 110, 139.1, 312/323, 317.3, 313; 49/255, 260, 254, 261, 257; 108/38, 40, 15

[56] References Cited

U.S. PATENT DOCUMENTS 631,312 8/1899 Macey .
929,566 7/1909 Dannheiser .
1,696,683 7/1923 Kieffer et al. .
1,918,475 7/1933 Lassinsky ..... 47/257
3,771,847 10/1976 Ayeworth ..... 312/323
4,537,452 8/1985 Rice et al. .

*Primary Examiner*—Kenneth J. Dorner
*Assistant Examiner*—Gerald A. Anderson

[57] ABSTRACT

A cabinet includes a plurality of compartments, each compartment having a door that is positionable in a closed position, a recessed position, and a posting shelf position. A tracking mechanism is connected adjacent a trailing edge of each door to slidably and pivotally mount the door relative to the compartment. Forward ends of a pair of support bars are pivotally connected to each door adjacent a leading edge. Rearward ends of the support bars include shoulder rivets that are slidably and pivotally mounted in slots formed in mounting panels. The door is in the posting shelf position when the shoulder rivets are seated in retaining portions of the slots.

4 Claims, 4 Drawing Sheets

FILE CABINET

BACKGROUND OF THE INVENTION

The present invention relates to filing cabinets. More particularly, it pertains to lateral shelf filing cabinets having doors for each compartment of the cabinet, where the doors can seal the particular compartment, recess to allow access to the compartment, or lock in a horizontal and extended position to function as a posting shelf.

Lateral shelf filing cabinets incorporate a number of compartments that each include a movable door. In existing designs, the door may be positioned to seal access to the compartment, or may be recessed within the compartment to permit access to the contents of the compartment.

It was found to be desirable to have a work space in or near the filing cabinet. As a result, posting shelves were included between the compartments of the cabinet. See, for example, U.S. Pat. No. 631,312, to F. Macey. Unfortunately though, separate shelves of this type had several drawbacks. The shelves increased the vertical height of the cabinet and decreased the overall storage efficiency of the cabinet. Also, cabinets incorporating separate shelves were generally more time consuming and expensive to manufacture.

To address these disadvantages associated with separate shelves, a cabinet was developed having doors that could also function as posting shelves. As is shown in U.S. Pat. No. 4,537,452 to T. E. Rice et al., the doors of this cabinet could be closed, recessed, or locked in a horizontal and extended position using spring-loaded support brackets mounted on the back sides of the doors. This design allowed each of the doors to function as a posting shelf, without increasing the height of the cabinet or sacrificing the storage efficiency of the cabinet. There are, however, significant drawbacks associated with this design. The user must manually position the brackets against the sides of the cabinet for the door to function as a shelf. This presents a serious problem when the user requires the posting shelf in order to unload articles, especially because both brackets must be adjusted simultaneously. Furthermore, there is potential for the support brackets to contact the user as the brackets spring back against the door.

It can therefore be seen that a need exists for an improved cabinet having a door that can assume a closed position, a recessed position, or a posting shelf position. It would be especially desirable for the user of the cabinet to be able to position the door in the posting shelf position by simply moving the door.

SUMMARY OF THE INVENTION

The present invention is an improved cabinet possessing a door that can assume an open position and a recessed position, and that can easily be maneuvered into a posting shelf position. The cabinet includes a compartment having at least one mounting panel. The mounting panel is formed with a slot having a primary portion and a retaining portion. A door of the cabinet has a leading edge and an opposite trailing edge, with a hinge attached to the door adjacent the trailing edge. A tracking mechanism is slidably mounted to the compartment and pivotally connected to the hinge to allow the door to recess. The cabinet also includes a support bar having a forward end that is pivotally connected to the door adjacent the leading edge, and a rearward end that is slidable within the slot.

When the tracking mechanism is slid forward in the compartment, the door can be pivoted to a horizontal and extended position. In the preferred embodiment, a shoulder rivet is attached to the rearward end of the support bar and is slidable within the slot. When the shoulder rivet is positioned in the retaining notch, the shelf is temporarily locked in the horizontal and extended position, and may be used as a posting shelf. This achieves one general object of the invention which is to enable the door to be used as a posting shelf.

Another object of the invention is to provide a cabinet door mounting structure that causes the door to function as a position shelf by simply manipulating the door. When the tracking mechanism is forward in the compartment and the door is pivoted between the closed position and a horizontal position, the shoulder rivet slides within the primary portion of the slot. Raising the leading edge of the door so that the door forms an angle of approximately 5 degrees with horizontal causes the shoulder rivet to move into the area of the retaining portion of the slot. Subsequently lowering the leading edge of the door so that the door is again horizontal causes the shoulder rivet to seat in the retaining portion. Thus, the door may be maneuvered into the posting shelf position by simply repositioning the door.

These and other objects and advantages of the invention will appear from the following description. In the description, reference is made to the accompanying drawings which form a part hereof, and in which there is shown a preferred embodiment of the invention. Such embodiment does not represent the full scope of the invention, and reference is therefore made to the claims herein for interpreting the scope of the invention.

DETAILED DESCRIPTION OF THE PREFERRED EMBODIMENT

Figure 1:
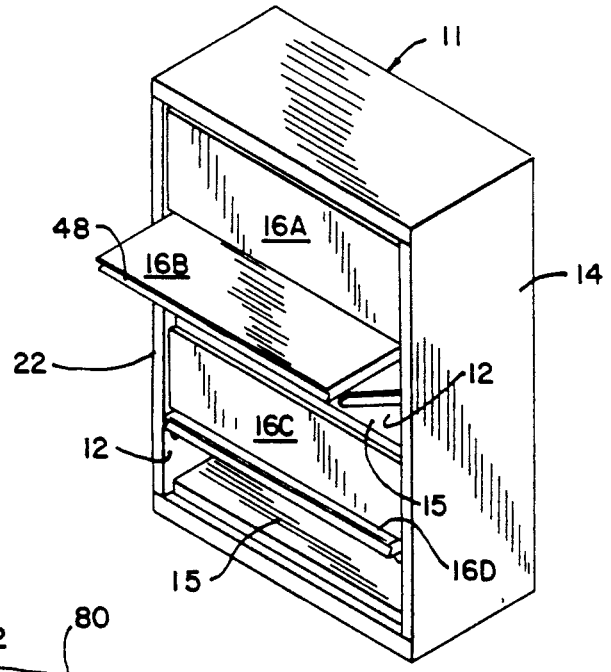
FIG. 1 is a view in perspective of a cabinet according to the present invention.

With reference to FIG. 1, a file cabinet 11 according to the present invention includes four storage compartments 12. The compartments 12 are formed in part by sides 14 and shelves 15 of the cabinet 11. Each compartment 12 includes a door 16 which may be positioned in a closed position as illustrated by doors 16A and 16C, an open and locked position as illustrated by door 16B, or a recessed position as illustrated by door 16D. In the open and locked position, the door 16B is generally horizontal and objects such as books and papers may be placed on the door. Thus, the door 16B in the open and locked position functions as a shelf, and this position will also be referred to as the posting shelf position. The cabinet 11 may include a locking mechanism (not shown) to secure the doors 16 in the closed position.

Figure 2:
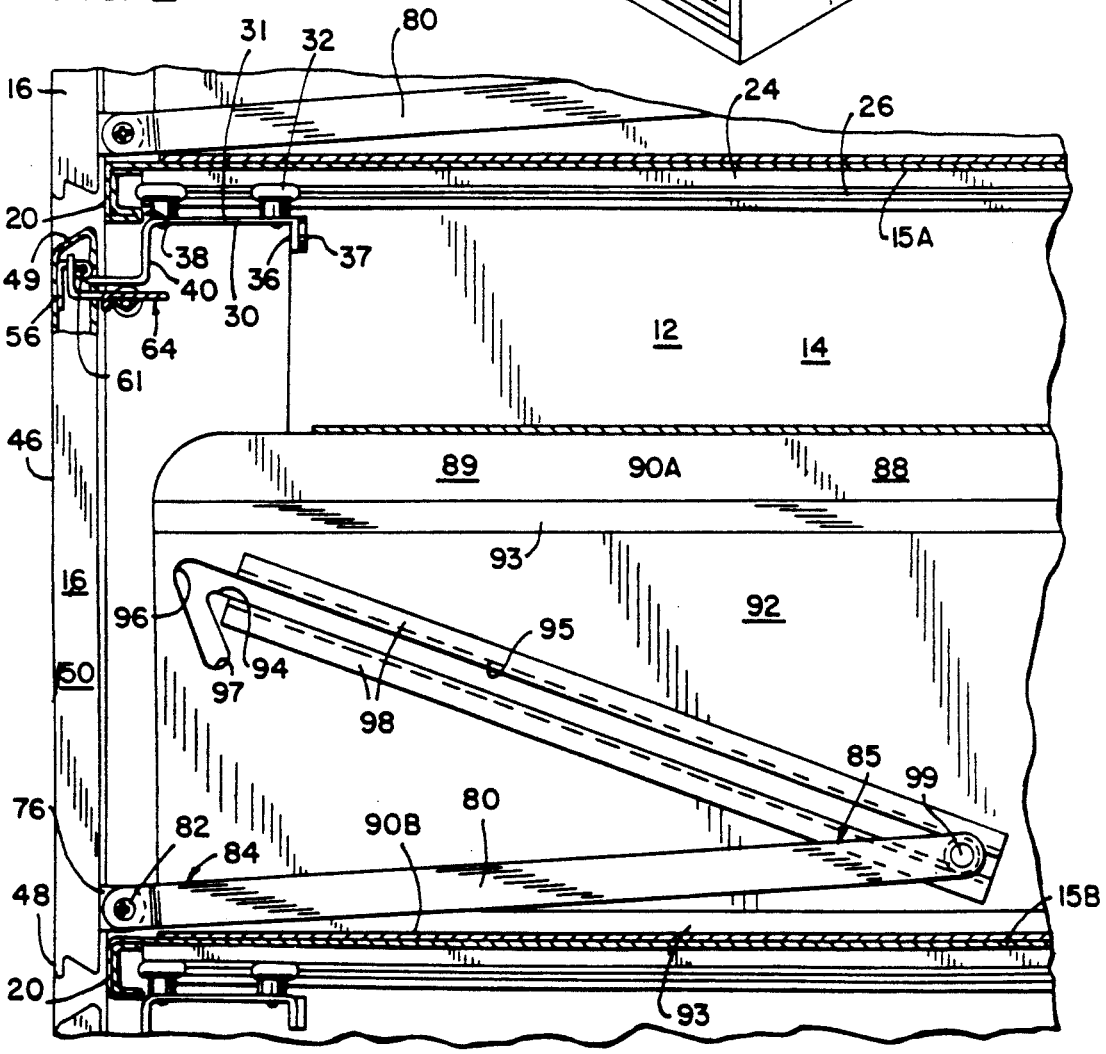
FIG. 2 is a view in vertical section of a portion of the cabinet, showing a cabinet door in a closed position, with portions broken away for the purposes of illustration.
Figure 4:
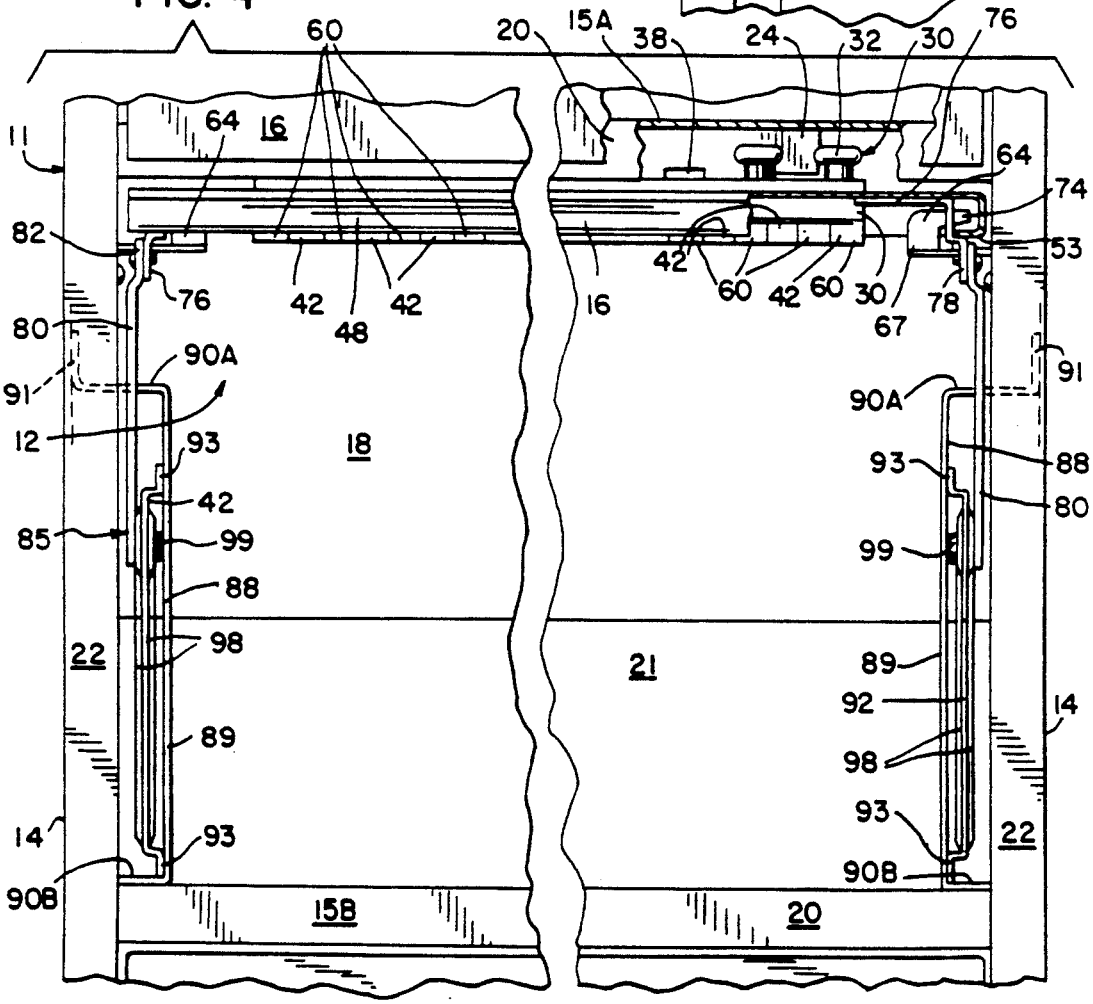
FIG. 4 is a front view of a portion of the cabinet, showing the cabinet door in the horizontal and extended position, with portions broken away for the purposes of illustration.

Referring now to FIGS. 2 and 4, each compartment 12 is defined by the sides 14 and a back wall 18 of the cabinet 11. The compartment 12 is also defined by the shelf 15A immediately above the compartment and the shelf 15B immediately beneath the compartment. Each of these shelves 15 is identically formed and includes a turned back nose portion 20 at the front of the compartment 12. The forward edges of the sides 14 of the cabinet 11 are bent inward to form a boarder 22 (FIGS. 1 and 4) for the front of the cabinet.

The shelves 15 are welded or otherwise suitably attached to the sides 14 of the cabinet 11. To provide additional strength, the rear of each shelf 15 includes a vertically-extending portion 21 (FIG. 4) which is welded or otherwise suitably fastened to the back wall 18.

Figure 7:
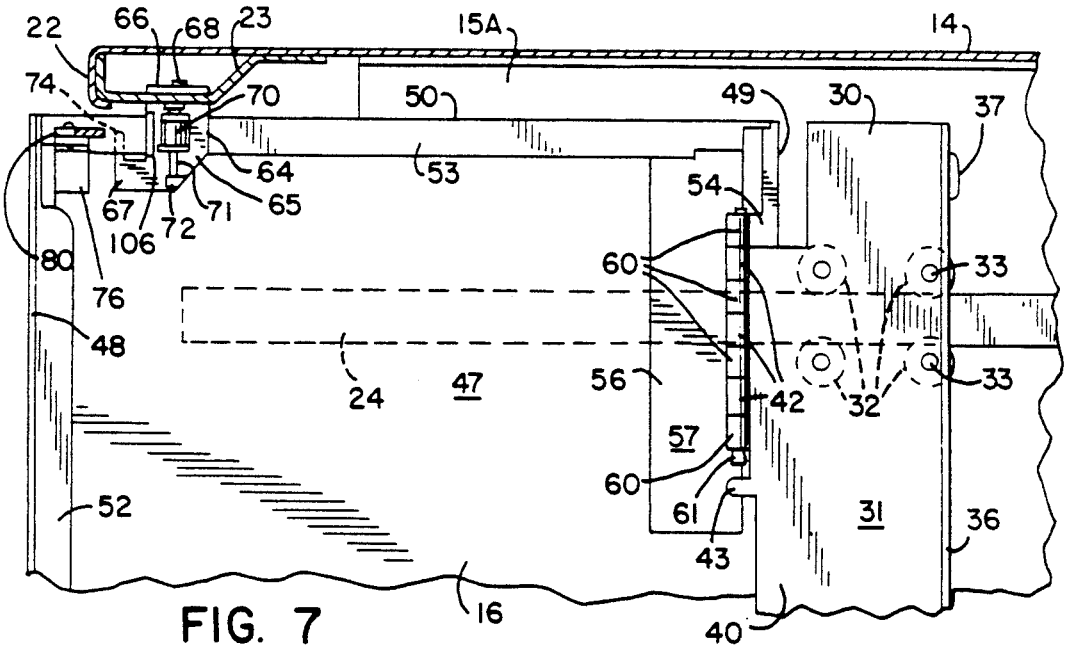
FIG. 7 is a view in horizontal section taken from the plane of the line 7—7 in FIG. 6.

For improved strength of the cabinet 11, support columns 23 are attached inside the front boarders 22. The columns 23 extend the entire height of the cabinet 11. As shown in FIG. 7, each support column 23 has a forward edge positioned against the inside portion of the front boarder 22. The column 23 is spaced apart from the side 14 for a distance, and then angles outward to contact a side 14. The support column 23 may be welded or otherwise suitable secured to the sides 14 and front panel 22.

Figure 3:
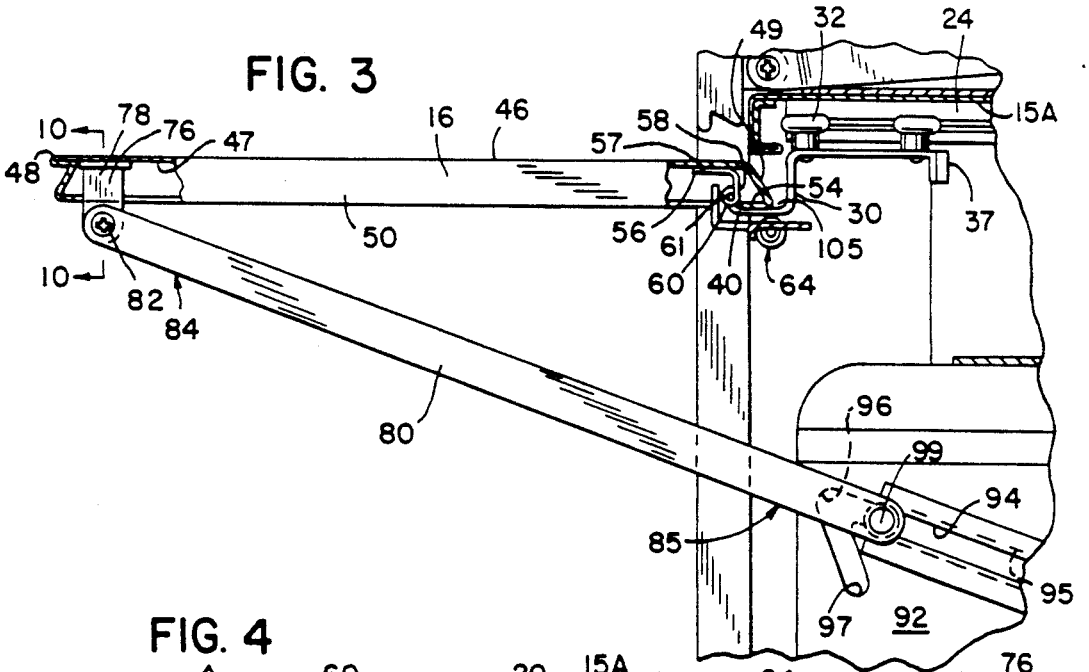
FIG. 3 is a view in vertical section similar to FIG. 2, but showing the cabinet door in a horizontal and extended position, with portions broken away for the purposes of illustration.

FIGS. 2, 3, 5 and 6 illustrate some of the different positions in which a user may move each door 16. In FIG. 2, the door 16 is in a closed position, where it is generally vertical and functions to seal the compartment 12. In FIG. 3, the door 16 has been pivoted to a generally horizontal and extended position. Note that the door 16 will normally not remain in this open position without the user holding the door. In the posting shelf position shown in FIG. 5, the door is generally horizontal as in FIG. 3, but it is also locked so that it may be used as a posting shelf. Finally, in FIG. 6, the door 16 has been slid into the compartment 12 to a recessed position. The support mechanisms for controlling the movement of the door 16 through these various positions are described below.

Figure 8:
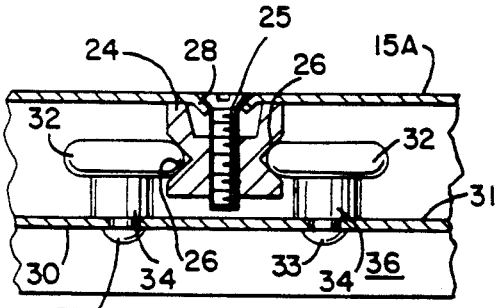
FIG. 8 is an enlarged view in vertical section taken from the plane of the line 8—8 in FIG. 6.

Within each compartment 12, the cabinet 11 includes a pair of runners 24 that are attached by fasteners 25 (FIG. 8) or other suitable means to the underside of the shelf 15A that defines the ceiling of the compartment 12. The runners 24 extend longitudinally from the back wall 18 toward the nose 20 of the shelf 15A, and are thus parallel to the sides 14. One runner 24 is spaced from one side 14 of the compartment 12 by a certain distance, and the second runner is preferably spaced from the opposite side 14 by the same amount. The particular distance may vary, although it is preferable to locate the runners 24 away from the center of the shelf 15A in order to provide the best support for the door 16. As best shown in FIG. 8, the runners 24 are formed with grooves 26 and threaded openings, which rotatively receive the fasteners 25. The shelves 15 include tapered holes 28 to receive the heads of the fasteners 25.

A tracking mechanism 30 is slidably mounted to the runners 24. The tracking mechanism 30 includes a rectangular-shaped primary surface 31 that is approximately the same length as the width of the door 16. Two sets of four rollers 32 (one set shown in FIG. 7) are attached to the upper side of the primary surface 31. The rollers are attached with stakes 33 (FIG. 8), and hubs 34 are used to space the rollers 32 from the primary surface 31. Each set of four rollers 32 is designed to ride along one of the runners 24. The rollers 32 are positioned and sized to ride within the grooves 26 of the runners 24. It will be apparent that glides or other sliding surfaces could be used in place of the rollers 32 to slide within the grooves 26.

The edge of the tracking mechanism 30 nearest the back wall 18 includes a lip 36 which extends the length of the tracking mechanism. A bumper 37 (FIGS. 2, 3, 5–7) may be attached to the lip 36 to interrupt movement of the tracking mechanism 30 as it glides toward the back wall 18 of the compartment 12. As will be apparent to those skilled in the art, whether the bumper 37 will contact the back wall 18 will depend on the depth of the cabinet 12 and the height of the doqrs 16. Similarly, the tracking mechanism 30 includes upwardly-extending bumper strips 38 (best shown in FIGS. 2 and 4) near the front of the primary surface 31. The bumper strips 38 contact the nose 20 of the shelf 15A to limit movement of the tracking mechanism 30 toward the front of the compartment 12.

An angled extension portion 40 (one shown in FIG. 7) of the tracking mechanism 30 extends downward from the front of the primary surface 31. Due to a 90 degree curve, the extension portion 40 also extends forward of the primary surface 31. As best shown in FIGS. 4 and 7, two sets of three tracking mechanism knuckles 42 are formed at the forward edge of the extension portion 40. Two forwardly-extending tabs 43 (one shown in FIG. 7) are spaced a short distance from each set of knuckles 42. As shown in FIG. 4, the two sets of knuckles 42 are located toward each end of the tracking mechanism 30.

Each door 16 is preferably formed of a sheet of a metal material having a top side 46 and an opposite bottom side 47. The edges of the sheet metal are bent to form a leading edge 48, a trailing edge 49 and sides 50 extending between the leading and trailing edges. The leading edge 48 is preferably bent in a Z-shaped cross section as shown in FIG. 3. Viewing the bottom side 47 of the door 16 in FIG. 7, it can be seen that the leading edge 48 of the door also includes an inwardly-directed flange 52. Likewise, the sides 50 of the door 16 are bent inward to form a retaining flange 53, and the trailing edge 49 is bent inward to form a trailing flange 54.

With particular reference to FIGS. 3 and 7, a pair of door hinges 56 (only one shown) are welded or otherwise suitably attached to the bottom side 47 of each door 16. Each door hinge 56 is formed with a rectangular-shaped contact surface 57. A flange 58 (FIG. 3) extends away from one edge of the contact surface 57 and includes four door hinge knuckles 60. Each door hinge 56 is positioned with the contact surface 57 against the bottom side 47 of the door 16, and one end of the contact surface 57 against a side 50 of the door 16. The flanges 58 are positioned against the trailing flange 54. With this positioning, the door hinge knuckles 60 interengage the tracking mechanism knuckles 42. A hinge pin 61 (FIG. 7) is inserted into the knuckles 42 and 60 to hingedly mount the door 16 to the tracking mechanism 30. The hinge pin 61 is preferably slightly curved to fit securely within the knuckles 42 and 60 and includes a flattened head to prohibit passing completely through the knuckles. The tabs 43 are positioned to block exit of the heads of the pins 61 from the knuckles 42 and 60.

Each compartment 12 includes two door retainers 64 (see FIGS. 5 and 7) having a main surface 65, an attachment surface 66, and a projection 67. The attachment surface 66 (FIG. 7) extends away from one edge of the main surface 65. Each door retainer 64 is mounted to one of the support columns 23 by inserting the attachment surface 66 through an appropriately sized slot (not shown) in the support column 23. The attachment surface 66 is secured to the support column 23 using a fastener 68 or other suitable means.

The main surface 65 of the door retainer 64 includes a relatively short downwardly-extending stop flange 106 near the front of the main surface, and a central opening for rotatively mounting a roller 70 on a pin 71. The roller 70 is preferably mounted by slitting and bending portions of the main surface 65 to create the central opening. The slit and bent portions include holes for inserting the pin 71. A tab 72 in the main surface 65 is pressed out to prevent removal of the pin 71 once the roller 70 is mounted. The roller 70 is rotatively mounted on the pin 71 with the longitudinal axis of the pin 71 is parallel to the leading edge 48 of the door 16.

The projection 67 of the door retainer 64 is formed such that it extends forward of the main surface 65, then upward of the main surface, and finally outward toward the support column 23, terminating in a tip 74 (FIGS. 4 and 7). As a result, the tip 74 is positioned above the retaining flange 53 of the door 16.

Figure 10:
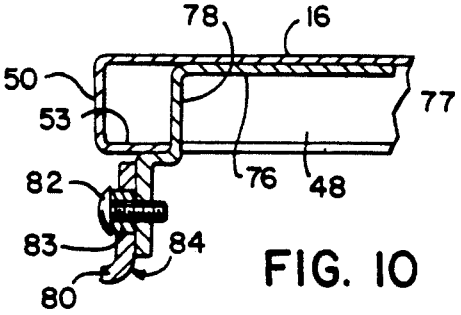
FIG. 10 is an enlarged view in vertical section taken from the plane of the line 10—10 in FIG. 3.

A pair of door support pivots 76 are attached to the bottom side 47 of each door 16. The door support pivots 76 include a body portion 77 and a downwardly-extending flange 78. The door support pivots 76 are mounted with the body portions 77 in contact with the bottom side 47 of the door 16, one support pivot 76 adjacent each of the corners formed by the leading edge 48 and the sides 50 of the door 16. The flange 78 extends downward from the bottom side 47 of the door 16, and is positioned against the retaining flange 53. As shown best in FIGS. 4 and 10, the downwardly-extending flange 78 is bent so that it contacts a portion of the underside of the retaining flange 53. The downwardly-extending flange 78 includes a threaded aperture which is used to pivotally mount a support bar 80.

Figure 9:
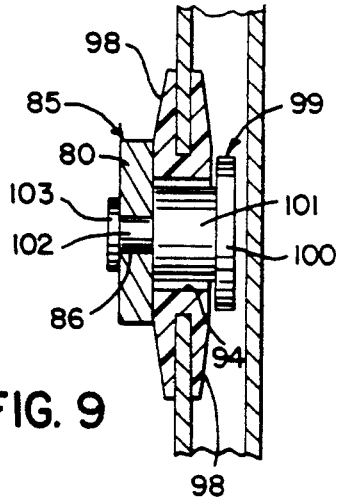
FIG. 9 is an enlarged view in vertical section taken from the plane of the line 9—9 in FIG. 6.

Each door 16 is pivotally attached to a pair of support bars 80 using a screw-type fastener 82 and a spacer 83 (FIG. 10), although other suitable means such as a pin connection could be used. Each support bar 80 has a forward end 84 an an opposite rearward end 85. Toward the forward end 84, the support bar 80 has an opening suitable large to pivotally receive the spacer 83. The fastener 82 passes through the interior of the spacer 83 and threadably inserts into the threaded opening of the door support pivot 76. Rearward of the opening for the fastener 82, the support bar 80 includes a slight bend or joggle, although the majority of the bar is straight. This slight joggle beneficially allows the head of the fastener 82 to be flush with the side 50 and the majority of the support bar 80. Toward the rearward end 85, the support bar 80 includes a second opening 86 (FIG. 9) for slidably and pivotally mounting the support bar relative to the sides 14 of the cabinet 11.

In each compartment 12, a pair of side panels 88 (FIGS. 2 and 4) are attached to the inside of the cabinet sides 14. Each side panel 88 includes a main portion 89 with upper and lower extensions 90A and 90B extending away from the main portion 89. A top flange 91 (FIG. 4), parallel to the main portion 89, is connected to the upper extension 90A. Each side panel 88 is mounted within the compartment 12 such that the lower extension 90B rests on the shelf 15B forming the floor of the compartment 12. The top flanges 91 are positioned against the inside of the sides 14. The side panels 88 may be secured to the shelf 15B and sides 14 by welds, screws, adhesives or other suitable means. The upper and lower extensions 90A and 90B function to locate the main portion 89 apart from the sides 14 of the cabinet. Each side panel 88 preferably extends into the compartment 12 to the back wall 18, but does not extend completely to the front of the compartment 12, thus allowing appropriate room for movement of the support bars 80.

A mounting panel 92 is generally rectangular in shape with legs 93 along opposite sides of the panel 92. The legs 93 are welded, screwed or otherwise suitable fastened to the main portion 89 of the side panel 88. As best shown in FIG. 2, the mounting panel 92 includes a slot 94 that extends in a diagonal direction across the mounting panel 92. The slot 94 is formed with a generally straight primary portion 95, an elbow portion 96 and a retaining notch or portion 97. The primary portion 95 runs from the lower, rear part of the mounting panel 92 to the upper, forward part of the mounting panel 92.

The width of the primary portion 95 of the slot 94 is slightly larger than the width of the elbow portion 96 or the retaining notch 97. Plastic edging 98 is clipped to the mounting panel 92 in the primary portion 95, and may be secured by a friction fit, adhesive or other suitable means. The width of the slot 94 between the strips of plastic edging 98 is approximately the same as the width in the retaining notch 97 and the elbow portion 96. This width is sufficient to accommodate a headed shoulder rivet 99.

The shoulder rivet 99 includes an enlarged head 100 (FIG. 9) and a shoulder 101. The shoulder 101 is sized to fit between the strips of plastic edging 98 so that the shoulder 101 may slide in the slot 94 along the primary portion 95, into and out of the elbow portion 96, and into and out of the retaining notch 97. The shoulder rivet 99 also includes a pin 102 and second head 103. The pin 102 is sized to fit in the opening 86 adjacent the rearward end 85 of the support bar 80. The second head 103 of the shoulder rivet 99 functions to retain the support bar 90 on the pin 102. The shoulder rivet 99 pivotally and slidably mounts the rearward end 85 of the support bar 80 relative to the mounting panel 92.

The closed position of the door 16 is illustrated in FIG. 2. The door 16 is generally vertical with the leading edge 48 positioned adjacent the lower shelf 15B which defines the floor of the compartment 12. The trailing edge 49 of the door 16 is positioned adjacent the shelf 15A which defines the ceiling of the compartment 12. When the door 16 is closed, the shoulder rivets 99 are positioned in the rearmost portion of the primary portion 95, remote from the elbow portion 96 and retaining notch 97. Additionally, the tracking mechanism 30 is positioned fully forward along the runners 24, such that the bumper strips 38 encounter the nose 20 of the shelf 15A.

The door 16 can be raised to the open position as shown in FIG. 3 by pivoting the door about the axis of the hinge pins 61. This may be accomplished by pulling outward and upward on the leading edge 48 of the door 16. The Z-shaped leading edge 48 provides a convenient place for users to grasp. As the door 16 moves toward the open position, the support bars 80 move forward in the compartment 12 with the shoulder rivets 99 sliding forward in the primary portion 95. The shoulder rivets 99 move easily and quietly within the plastic edging 98. Additionally, the support bars 80 pivot with respect to both the door support pivots 76 and the mounting panel 92.

The length of the support bar 80 is such that, when the door 16 is horizontal and the tracking mechanism 30 is forward against the nose 20, the shoulder rivets 99 are positioned at the forward end of the primary portion 95, adjacent the elbow portion 96. Note that the door 16 will not remain in the open position (FIG. 3) unless the door is held by the user.

As the door 16 pivots from the closed position to the open position, the trailing edge 49 passes beneath the nose 20 of the upper shelf 15A. The trailing edge 49 approaches but does not contact the angled extension portion 40 of the tracking mechanism 30. When the door 16 is open, or horizontal, there is a slight gap 105 (FIG. 3) between the trailing flange 54 of the door 16 and the angled extension 40 of the tracking mechanism 30.

Figure 5:
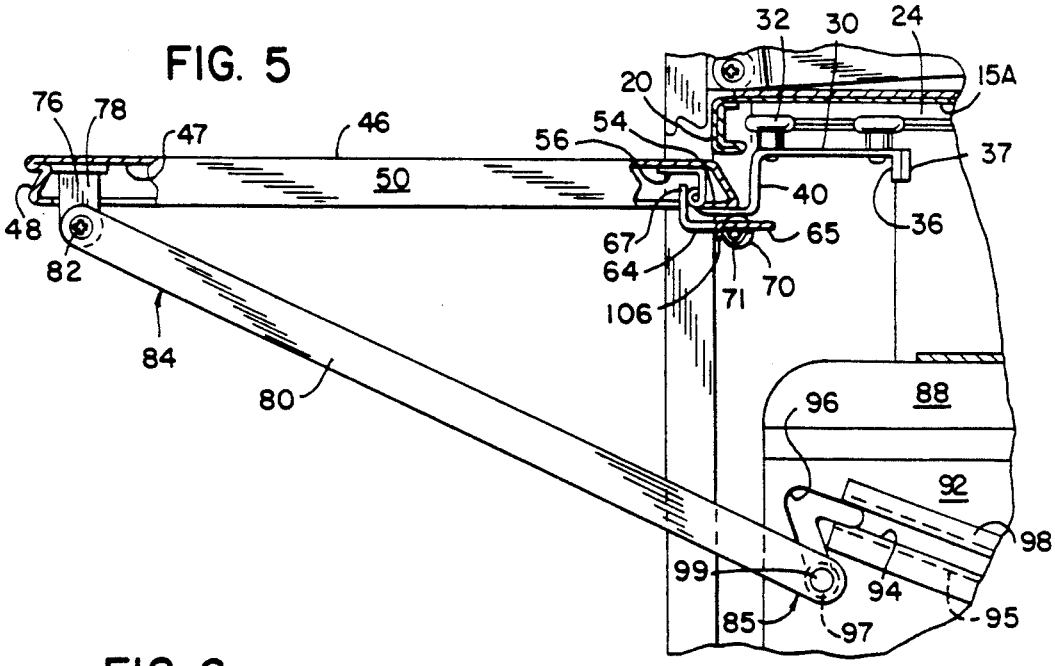
FIG. 5 is a view in vertical section similar to FIG. 2, but showing the cabinet door in a posting shelf position, with portions broken away for the purposes of illustration.

From the open position (FIG. 3), the door 16 can be moved into the posting shelf position illustrated in FIG. 5. To accomplish this, the leading edge 48 of the door 16 is raised such that the door forms an angle of approximately 5 degrees with horizontal. The door 16 pivots about the axis of the hinge pins 61 and the trailing flange 54 of the door approaches the angled extension 40 of the tracking mechanism 30, thereby reducing the size of the gap 105. As the door 16 pivots above horizontal, the shoulder rivets 99 of the support bars 80 are pulled forward in the slot 94 such that the shoulder rivets 99 enter the elbow portions 96. The leading edge 48 is subsequently lowered so that the door 16 again becomes horizontal. As the leading edge 48 is lowered, the shoulder rivets 99 slide from the elbow portions 96 to the retaining notch 97 (see FIG. 5) due to the force of gravity. In this position, the door 16 functions as a posting shelf, and objects may be placed on the top side 46 of the door. The weight of the door 16 and the objects is supported by the support bars 80. Thus, the door 16 can be moved into a posting shelf position by simply pivoting door about the axis of the hinge pins 61.

To release the door 16 from the posting shelf position, the leading edge 48 is again raised so that the door forms an angle of approximately 5 degrees with horizontal. This causes the shoulder rivets 99 to move from the retaining notches 97 to the elbow portions 96 of the slots 94. While lowering the leading edge 48 back to horizontal, the user simultaneously applies a slight upward force on the support bars 80. As a result, the shoulder rivets 99 are prevented from falling back into the retaining notches 97, but rather travel from the elbow portions 96 to the forwardmost segment of the primary portions 95. The door 16 is once again in the open position illustrated in FIG. 3.

Figure 6:
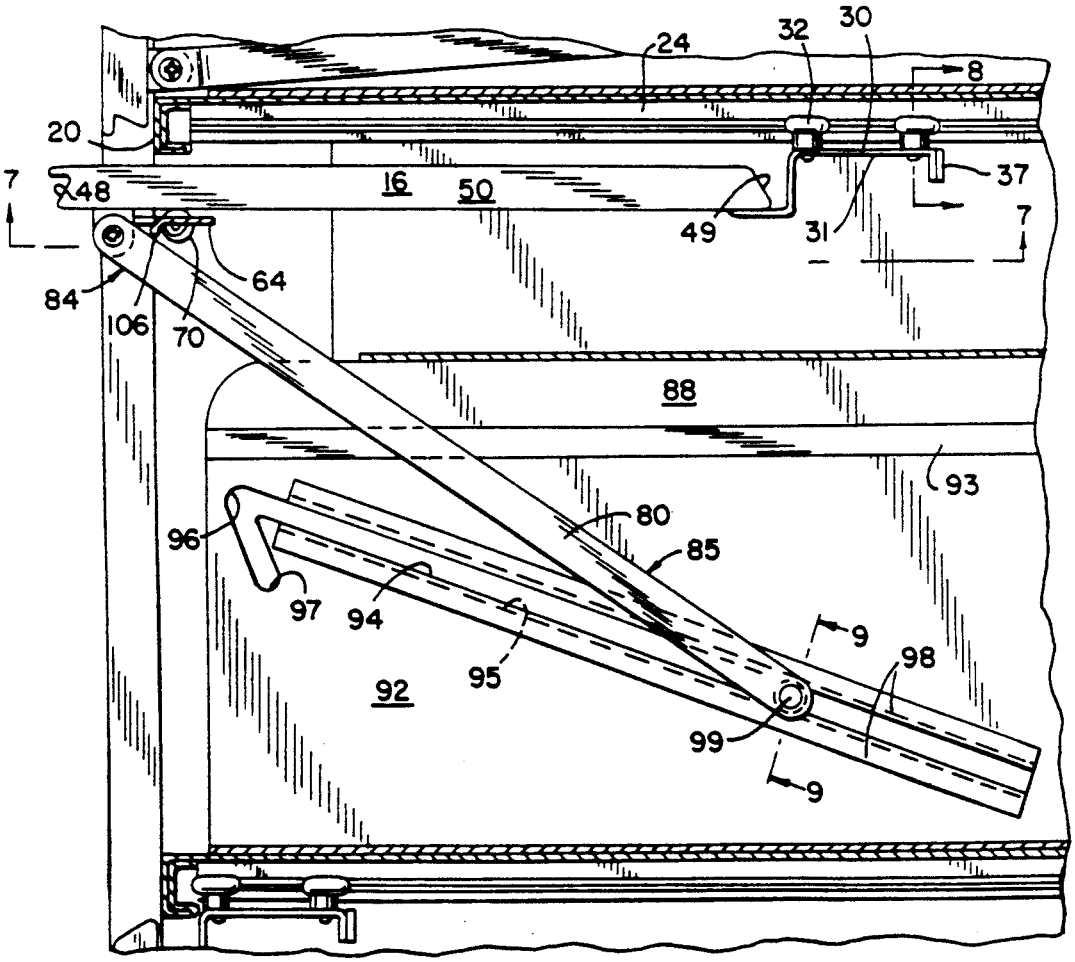
FIG. 6 is a view in vertical section similar to FIG. 2, but showing the cabinet door in a recessed position.

From the open position, the door 16 may also be slid into the cabinet 11 to the recessed position illustrated in FIG. 6. From the open position, the user need only push the leading edge 48 of the door 16 toward the back wall 18 of the compartment 12. The force on the door 16 causes the tracking mechanism 30 to roll rearward on the runners 24. Additionally, as the door 16 moves into the compartment 12, the shoulder rivets 99 slide rearward in the primary portions 95 of the slots 94 to locations remote from the elbow portions 96 and the retaining notches 97.

As the door 16 moves into the compartment 12, the door retainers 64 prevent the leading edge 48 of the door from dropping substantially beneath horizontal. The retaining flanges 53 rest on the rollers 70 of the door retainers 64. The rollers 32 of the tracking mechanism 30 and the rollers 70 of the door retainers 64 provide easy movement of the door 16 into the recessed position. Also, the tip 74 of the projection 67 prevents the door 16 from being raised above horizontal and contacting the upper shelf 15A when the door 16 is partially recessed.

Inward movement of the door 16 toward the recessed position is halted by one of two occurrences, which depend on the exact size of the compartment 12 and door 16. For generally shallow compartments, the bumper 37 on the lip 36 of the tracking mechanism 30 will contact the back wall 18. For deeper compartments, the downwardly-extending stop flanges 106 of the door retainers 64 contact the support bars 80 and the projections 67 contact the door support pivots 76. This second scenario is illustrated in FIG. 6. The door 16 may be opened from the recessed position by grasping the leading edge 48 and pulling it outward, away from the back wall 18.

The present design is especially useful because the compartment door 16 itself functions as a posting shelf. The cabinet 11 can thus incorporate a posting shelf without increasing the height of the cabinet or decreasing significantly its storage capability. Furthermore, the present door mounting structure is beneficial because it can be used to retrofit existing cabinets. Thus, the doors of existing cabinets can be made to function as posting shelves without changing the outward appearance of the cabinet.

It should be apparent to those skilled in the art that many variations are possible from the preferred embodiment of the invention described herein. For example, the position of the door 16 could be adequately controlled using a single support bar 80. The rearward end 85 of the support bar 80 could be slidably and pivotally mounted in a slot located near the center of the compartment. Similarly, the door mounting mechanism could be modified so that the shoulder rivet 99 rides in a slot formed in either the side panel 88 or the sides 14. Therefore, the invention should not be limited by the specific embodiment described, but only by the claims.

I claim:

1. A cabinet, comprising:

a compartment having at least one mounting panel formed with a slot, the slot having a primary portion and a retaining portion at one end of the primary portion;

a door having a leading edge and an opposite trailing edge;

means connected to the door adjacent the trailing edge for slidably and pivotally mounting the door relative to the compartment;

a support bar having a forward end pivotally connected to the door toward the leading edge and having an opposite rearward end slidable within the slot, said slot and said support bar being positioned relative to each other such that the rearward end of the support bar slides within the primary portion in a first direction and short of the one end when the door is pivoted from a closed position to an open position, the rearward end of the support bar slides within the primary portion in a second opposite direction when the door is slid from the open position to a recessed position, and the rearward end of the support bar may be seated within the retaining portion to hold the door in a horizontal posting shelf position; and a retaining member attached to the compartment, the retaining member including a roller, the door riding on the roller when the door is slid from the open position to the recessed position.

2. A cabinet, comprising:

a compartment having a front end, an opposite back end, a floor extending between the front and back ends, a ceiling opposite the floor, and sides extending between the floor and ceiling;

an upright mounting panel fixed relative to the sides, the mounting panel having a slot with a primary portion, a retaining notch at an end of the primary portion, and an acute angle elbow portion between the primary portion and the retaining notch;

a door having a leading edge and an opposite trailing edge;

means connected to the door adjacent the trailing edge for slidably and pivotally mounting the door relative to the compartment; and a support bar having a forward end pivotally connected to the door toward the leading edge and having an opposite rearward end slidably mounted in the slot, said door being movable between a vertical position in which it closes the front end of the compartment and a recessed position in which the door is generally horizontal and slidably received within the compartment as said support bar moves along the primary portion of said slot, and said door also being movable to a posting shelf position in which the door is horizontal and projects outwardly of the front end of said compartment when the support bar is moved beyond the elbow portion and into the notch.

3. The cabinet of claim 2, wherein the means for slidably and pivotally mounting the door include:

a runner attached to the ceiling, the longitudinal axis of the runner being parallel to the sides, the runner including longitudinal grooves;

a hinge attached to an underside of the door adjacent the trailing edge;

a tracking mechanism having rollers positioned in the grooves, the rollers permitting movement of the tracking mechanism relative to the compartment, the tracking mechanism being pivotally connected to the hinge.

4. The cabinet of claim 2, wherein the rearward end of the support bar includes a shoulder rivet that is slidable within the slot.

* * * * *